US005980196A

United States Patent [19]

Roth

[11] Patent Number: 5,980,196

[45] Date of Patent: Nov. 9, 1999

[54] COUNTER-EJECTOR AND BOX FEED MACHINE

[75] Inventor: Curtis A. Roth, Post Falls, Id.

[73] Assignee: Thermoguard Equipment, Inc., Spokane, Wash.

[21] Appl. No.: 09/078,304

[22] Filed: May 13, 1998

[51] Int. Cl.[6] ..... B65G 57/11

[52] U.S. Cl. ..... 414/790.8; 414/794.5; 198/462.3; 198/592

[58] Field of Search ..... 198/369.2, 462.1, 198/462.2, 462.3, 592, 626.2, 626.3, 626.5, 812; 414/790.3, 790.8, 789.1, 794.4, 794.5

[56] References Cited

U.S. PATENT DOCUMENTS

| | | | |
|---|---|---|---|
| 2,606,669 | 8/1952 | Morrison | 414/790.7 |
| 3,580,402 | 5/1971 | Tolf | 414/790.8 |
| 3,892,168 | 7/1975 | Grobman | 414/790.8 |
| 3,905,478 | 9/1975 | Hoke et al. | 414/790.8 |
| 3,938,674 | 2/1976 | Kroeze et al. | 414/790.8 |
| 4,359,218 | 11/1982 | Karis | 414/790.8 |
| 4,425,068 | 1/1984 | Wilson et al. | 414/790.8 |
| 4,436,472 | 3/1984 | Kunzmann | 414/790.8 |
| 4,577,746 | 3/1986 | Tokuno et al. | 198/462.2 |
| 4,667,953 | 5/1987 | Hirakawa et al. | 198/462.2 |
| 5,026,249 | 6/1991 | Shill | 414/789.1 |
| 5,039,083 | 8/1991 | Senn | 414/790.8 |

FOREIGN PATENT DOCUMENTS

| | | | |
|---|---|---|---|
| 2315813 | 10/1973 | Germany | 414/790.8 |

*Primary Examiner*—Christopher P. Ellis
*Assistant Examiner*—Gregory A. Morse
*Attorney, Agent, or Firm*—Wells, St. John, Roberts Gregory & Matkin P.S.

[57] ABSTRACT

A counter-ejector and feeder for receiving flexible boxes delivered at a prescribed infeed rate in end-to-end relation along a plane, and a counter-ejector machine, for stacking the boxes in discrete bundles for discharge. The machine includes a general framework mounting a shingling conveyor that provides a working flight leading from an infeed end to a discharge end. The shingling conveyor is positioned with an infeed end below the delivery plane and leads angularly upwardly to a counter-ejector discharge. A driver operates the shingling conveyor to move the working flight at a selected speed less than the delivery rate of boxes to the shingling conveyor. The working flight of the shingling conveyor is inclined upwardly to a counter-ejector discharge end where shingled boxes are fed to a counter-ejector. Successive stacks of boxes are formed by the counter-ejector which includes structure for stacking and maintaining the boxes in a compressed condition. Boxes delivered from the infeed plane are deposited onto the shingling conveyor in a shingled, overlapping configuration, transported at said selected speed to the counter-ejector where counted numbers of the boxes are stacked and discharged.

14 Claims, 13 Drawing Sheets

COUNTER-EJECTOR AND BOX FEED MACHINE

TECHNICAL FIELD

The present invention relates to preparation and delivery of sheets, particularly partially folded boxes through a counter-ejector machine.

BACKGROUND OF THE INVENTION

Sheet material such as that used in corrugated box construction is typically discharged single file and along a plane from a finishing machine in which the sheets are printed (with fast drying inks), shaped, creased, perforated or otherwise treated by the finishing machine. The sheets may be rectangular or of other configurations, but are typically flat and unfolded when leaving the finishing machine as shown at A in FIG. 1 of the drawings.

Forming rails and glue application heads are typically used downstream of the finishing machine to form the sheet material into desired configurations as they move along. A typical configuration is a partially folded box B, the folding process for which is exemplified in FIG. 1 of the drawings.

In existing technology, the boxes are counted and accumulated in bundles by a counter-ejector machine. This is an area where difficulty is experienced, since the boxes being fed along a plane, in end-to-end relation often have a tendency to re-open at the glue lines (see G in FIG. 1) as they leave the folding rails. If a glue line re-opens, the loose flaps F can cause frustrating and costly down-time while the single box is pulled from the counter-ejector.

Another problem with current feed systems for counter-ejectors is encountered when attempts are made to accumulate the boxes fed from a finishing machine, even if the glue joints hold. A finishing machine may operate to discharge partially folded boxes at a rate of up to 1000 feet per minute. The glue applicators and forming rails are capable of operating at a similar rate. However, it becomes difficult to effectively control accumulation of boxes into bundles at such a high feed rate.

One solution to the above problems is to slow down the box feed rate. This is an undesirable solution since the finishing machine should run at or near maximum efficiency, or the printing ink will dry and clog the printing heads.

Another solution to the above problem is to use hold-down devices on the glued boxes and to keep pressure on the glued joints until the glue cures. The problem with this solution is that the formed boxes are moving along at speeds up to approximately 1000 feet per minute. At this rate if the glue sets sufficiently in, say, 15 seconds, the distance from the glue applicator to the counter-ejector should be at least 250 feet. This is not acceptable either in terms of space limitations or in cost of equipment.

A still further problem comes with the nature of the hold-down devices in current use. Rollers have been used to press against the top surfaces of formed boxes as they move along, to hold the glued joints together. But rollers do not engage continuously and can catch a box edge, creating a jam in the machine. Another difficulty with rollers is that the surface contact sometimes causes damage to the engaged box surfaces.

An additional problem is realized when boxes of different dimensions are to be formed and collected. Adjustments must be made to accommodate the different box dimensions. This often takes a considerable amount of time and experimentation.

A still further problem occurs especially with counter-ejectors when stacking box blanks is required. The folded flaps on the boxes usually form a "tent" configuration, creating a difficulty for counter-ejectors to operate without occasional jams, especially as the boxes leave the feed conveyor and are accumulated in a counted stack on the ejector. This is due in large part to a lack of controlled engagement against the box flaps as the boxes leave the feed conveyor. The problem becomes exacerbated in situations where the glue has not completely set and the flaps become loose.

Loss of control also occurs at the point where the successive boxes are discharged from the feed conveyor to the counter-ejector machine. This is due in large part to the unpredictable nature of the partially folded boxes as they fall onto the stack. Guides have been developed to keep the stacks uniform, but little has been done to provide positive control of the boxes as they fall, especially at high feed rates.

Attempted solutions to this perplexing problem have usually involved some form of temporary intermediate support for the incoming boxes, to support the presently building stack while previously formed stacks are removed. Plates or fingers have been used for this purpose, moved into the path of descending boxes to provide temporary support.

Simply sliding a solid plate between falling boxes appears feasible, except that the speed at which the plate must move is prohibitive and dangerous. Further, a box edge is inevitably engaged and crushed by the leading edge of the fingers or plate.

Recognizing the above problems, the box stacking industry has resigned itself to slowing or stopping box infeed flow while formed stacks of the partially formed boxes are removed from below the stacker magazines. Unless slower drying ink is used, increased maintenance is experienced, especially at the printer area when ink dries in the printer machinery due to the stoppage.

From the above problems and inadequate solutions, it may be understood that need remains for a counter-ejector and feed system that can be placed in line with a box former, that will assure consistent and accurate feed of boxes and stacking in the counter-ejector regardless of the curing time required for the formed box joints, that will take up minimum floor space, and that will allow the associated finishing machine to run at efficient speeds. There is also a need for a counter-ejector with capability to accept and stack partially formed boxes. The present invention fills this need, as will be understood from the following description.

BRIEF DESCRIPTION OF THE DRAWINGS

Preferred embodiments of the invention are described below with reference to the following accompanying drawings.

FIG. 1 is a flow diagram illustrating the sequence in which a series of boxes are folded and formed into a stack;

FIGS. 6–10 are sequence views showing operation of the present machine in areas adjacent the counter-ejector;

FIGS. 12–14 are diagrammatic views illustrating passage of a measured stack from the counter-ejector through the press conveyor and onto a downstream device.

DETAILED DESCRIPTION OF THE PREFERRED EMBODIMENTS

Figure 11:
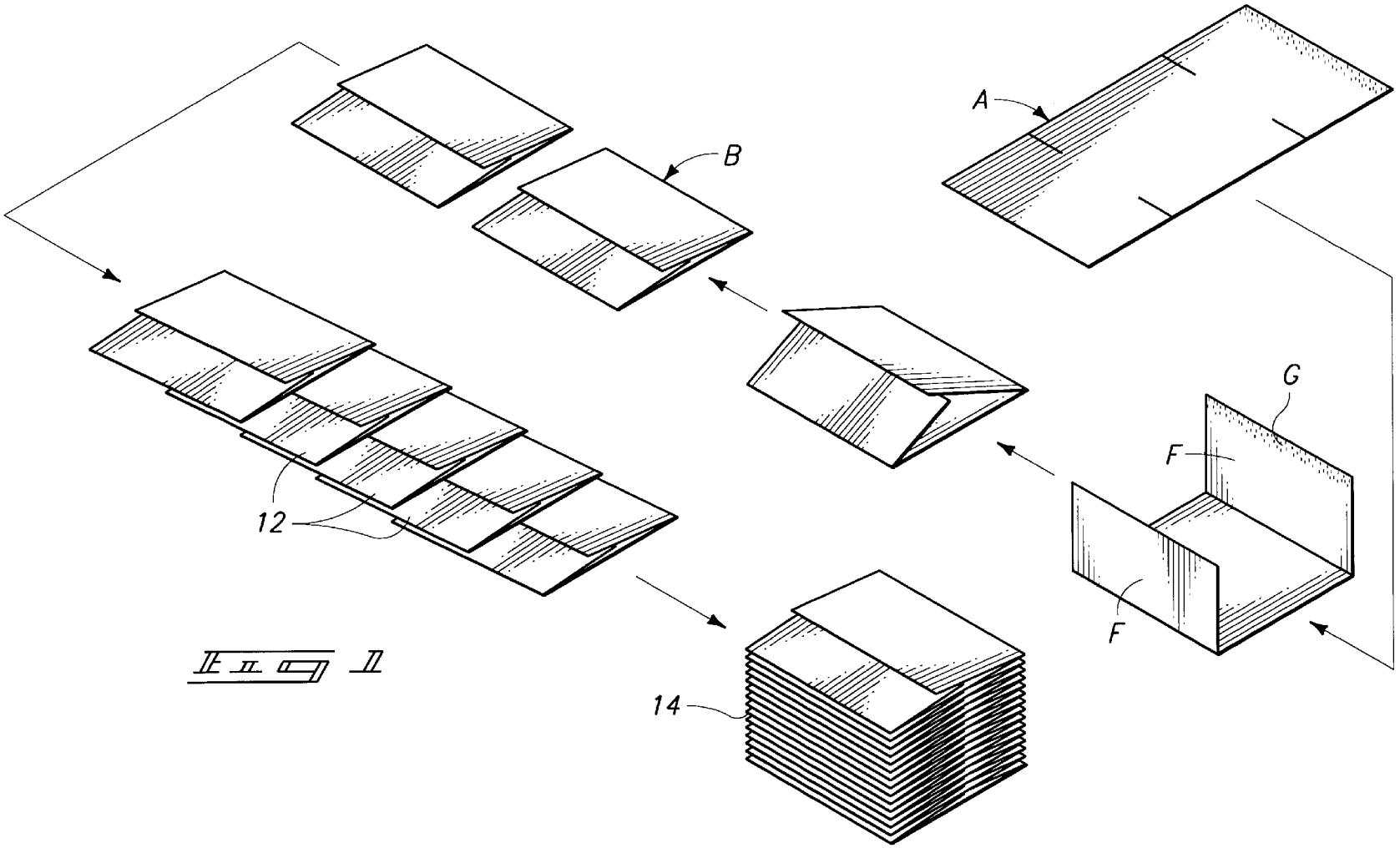
FIG. 11 is a side elevation view similar to FIG. 5 only showing a different operational relationship of the components.

This disclosure of the invention is submitted in furtherance of the constitutional purposes of the U.S. Patent Laws "to promote the progress of science and useful arts" (Article 1, Section 8).

A preferred counter-ejector and box feed machine is shown in the drawings incorporating features of the present invention, as generally referred to by the reference numeral 10. The box feeder portion of the present machine 10 is indicated at 11 and is used to receive individual partially folded boxes 12 fed end-to-end from forming rails (not shown). The box feeder 11 organizes the received boxes 12 in a shingled stream which is delivered from an upstream source 18 to the counter-ejector portion shown generally at 13. The counter-ejector portion 13 of the machine 10 is utilized to receive, count and gather groups of the boxes 12 into measured stacks 14 which are fed to a press conveyor 16, then discharged to a downstream device 17 for shipping and later handling. It should be noted that the upstream and downstream apparatus 18 and 17 are not part of the present invention.

As exemplified in the drawings, the preferred machine 10 includes a primary frame 15 that mounts the box feeder 11, the counter-ejector 13, and the press conveyor 16. All elements of these components are mounted to a primary framework 15 and may be adjustably positioned on the framework about an axis X noted in FIG. 2. An up position of the machine is shown in solid lines in FIG. 2. A down position is shown by dashed lines.

Reference is now made in greater detail to the box feeder portion 11. The box feeder 11 receives boxes 12 delivered at a prescribed delivery rate and in end-to-end relation along a delivery plane P (FIG. 2) from an upstream apparatus 18 such as a set of folding rails fed by a finishing machine (not shown). By way of example, a prescribed delivery rate from the upstream apparatus 18 will be given at 1,000 feet per minute. Thus the box feeder 11 will receive boxes 12 moving along plane P at 1,000 feet per minute from the upstream apparatus 18.

The box feeder 11 is mounted to the primary frame 15, supporting a shingling conveyor 20 having an elongated working flight 21 leading from an infeed end 22 to a counter-ejector discharge end 23. In a preferred form, the shingling conveyor 20 includes infeed end rolls 26 and counter-ejector discharge end rolls 27 mounting a number of conveyor belts 28 (one of which is shown). Upper flights of the conveyor belts 28 define the working flight 21.

A common driver 30 powers the shingling conveyor 20 to move the working flight 21 at a feed rate that is selected to be slower than the delivery rate from the upstream apparatus 18. The differential of feed rate (for the shingling conveyor 20) and the delivery rate (for the upstream apparatus 18) determines the amount of overlap one box 12 will have in relation to the preceding box 12 in the stream.

For example, if the selected feed rate is at 500 feet per minute, and the delivery rate is 1,000 feet per minute, a 50% overlap will occur (if the delivered boxes are fed in end-to-end relation). That is, half the length of one box will overlap the previous box.

The infeed end 22 of the shingling conveyor is positioned below the infeed plane P, so the leading edges of the boxes 12 will drop elevationally onto the shingle conveyor. The working flight 21 of the shingling conveyor 20 is generally inclined angularly upward from its infeed end 22 to a counter-ejector discharge end 23. The driver 30 is selectively operable to move the working flight 21 in a direction away from the infeed end 22 toward the counter-ejector discharge end 23.

The shingling conveyor 20 is mounted with the primary frame 15 for movement about the pivot axis X that is situated downstream the counter-ejector discharge end 23. The pivot location enables the present machine to be pivoted on the axis X to change the elevational position of the infeed end 22 without varying the elevation of the counter-ejector discharge end 23 relative to, the counter-ejector 13 and the press conveyor 16. This minimizes the need for adjustments to facilitate discharging boxes 12 from the counter-ejector 13, and allows for selective adjustment of the shingling conveyor 20 for receiving boxes 12 of different lengths (the length dimension being measured in the direction of flow).

Figure 2:
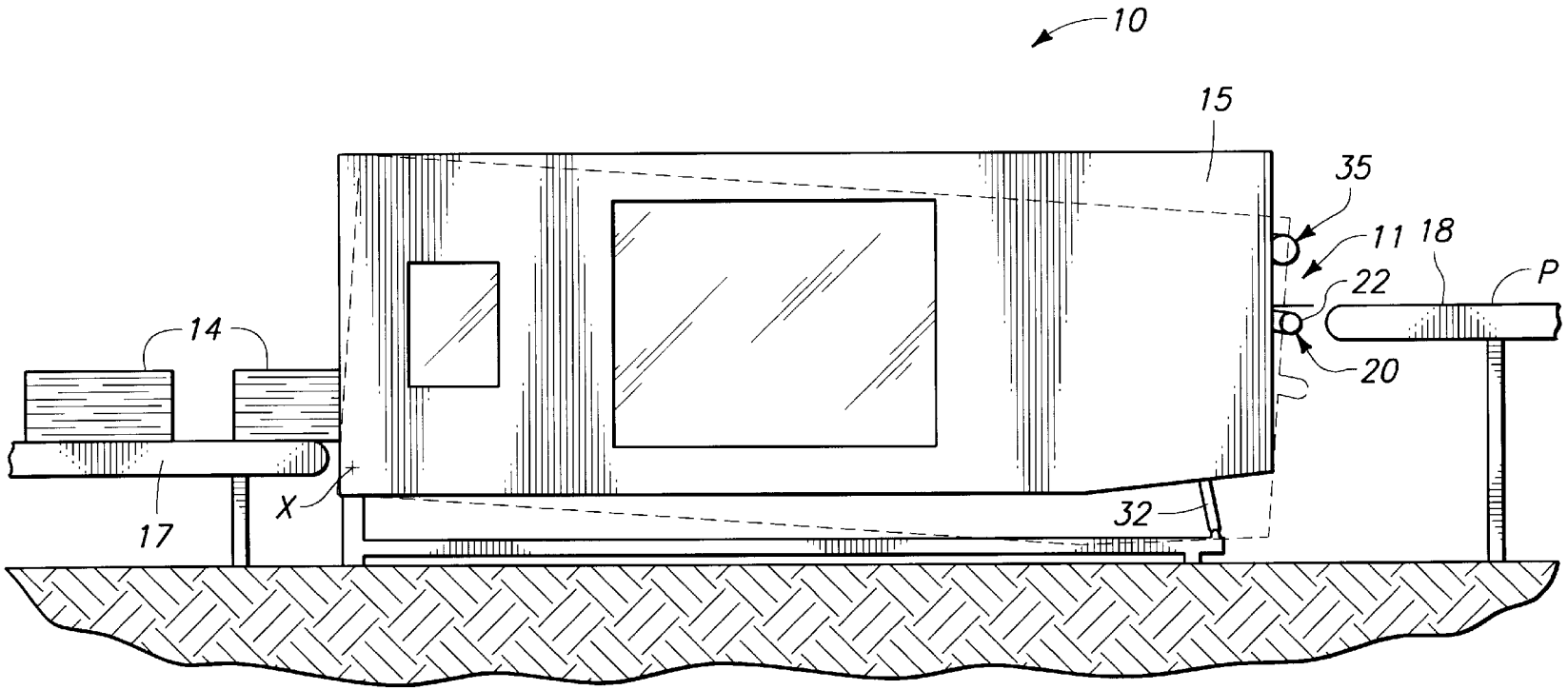
FIG. 2 is a side elevation view of a preferred counter-ejector and box feed machine.

It is preferred that the machine 10 be pivoted on the axis X relative to the infeed plane P through a prescribed angular range. A range between approximately 6°–18° is useful, with a range of approximately 12° being preferred. An exemplary range of angular adjustment for the shingling conveyor is illustrated in FIG. 2. It is noted that the infeed end 22 will stay elevationally below the infeed plane P throughout the angular range.

When the shingling conveyor 20 is set with the working flight 21 at a low angle to the horizontal, short boxes are more readily accepted from the fixed height of the infeed plane P. When the shingling conveyor 20 is set so the working flight 21 is at a steeper angle, longer boxes are more readily accepted.

A machine hoist cylinder 32 (FIGS. 2, 5 and 11) is provided below the infeed end 22 of the shingling conveyor 20. Cylinder 32 may be selectively operated to pivot the machine 10 about the axis A, through the prescribed angular range. The angular adjustment may be made without interrupting flow from the upstream apparatus 18, if desired, and without requiring separate adjustment of the counter-ejector 13 and press conveyor 16 since they too are mounted to the primary frame 15 for pivotal movement about the pivot axis X.

In preferred forms of the box feeder section 11, a hold-down conveyor 35 is positioned in the primary frame 15 above the shingling conveyor 20 to engage and press against the shingled stream of boxes moving along the working flight 21 of the shingling conveyor 20. The hold-down conveyor 35 is not powered but if desired, could be driven at the same approximate rate as the shingling conveyor 20 so there is no significant sliding contact with the exposed top surfaces of the shingled boxes 12.

The exemplified hold-down conveyor 35 is mounted directly above the working flight 21 of the shingling conveyor 20 and includes a number of laterally spaced belts 36 (one of which is shown) are aligned across the shingling conveyor. Working flights 37 of the belts 36 are arranged substantially parallel to the working flight 21 of the shingling conveyor 20. The belts 36 are trained over hold-down infeed rolls 38 at an upstream end. Deflector rolls 39 are part of a downstream deflector end 43 along the working flight 37 and are spaced further downstream than the discharge end rolls 27 of the shingling conveyor as shown in FIGS. 4 and 6–10.

Figure 4:
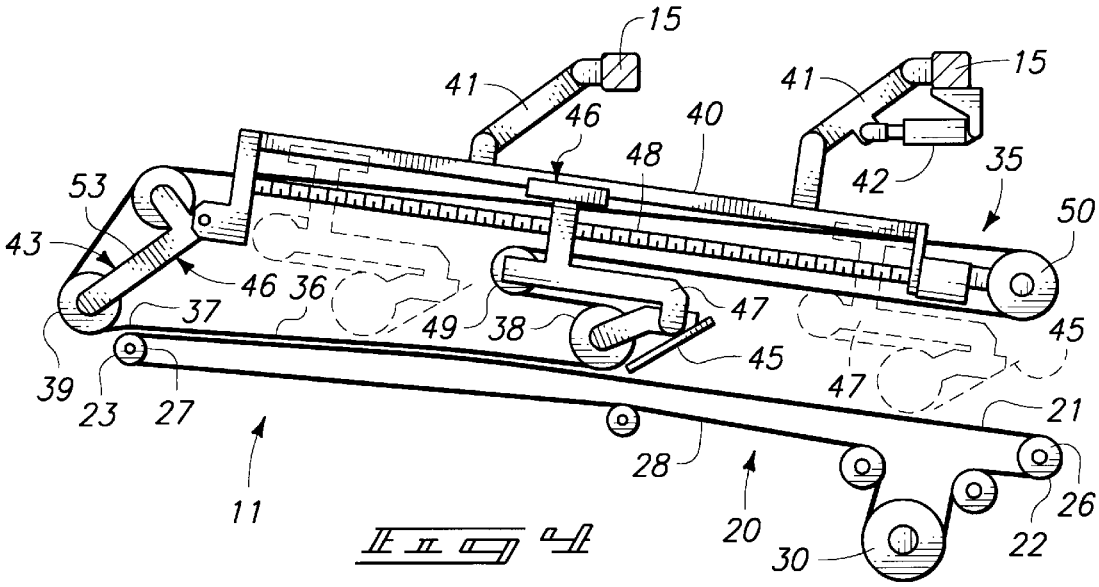
FIG. 4 is a diagrammatic side elevation view of the mounting structure for a hold-down conveyor.
Figure 11:
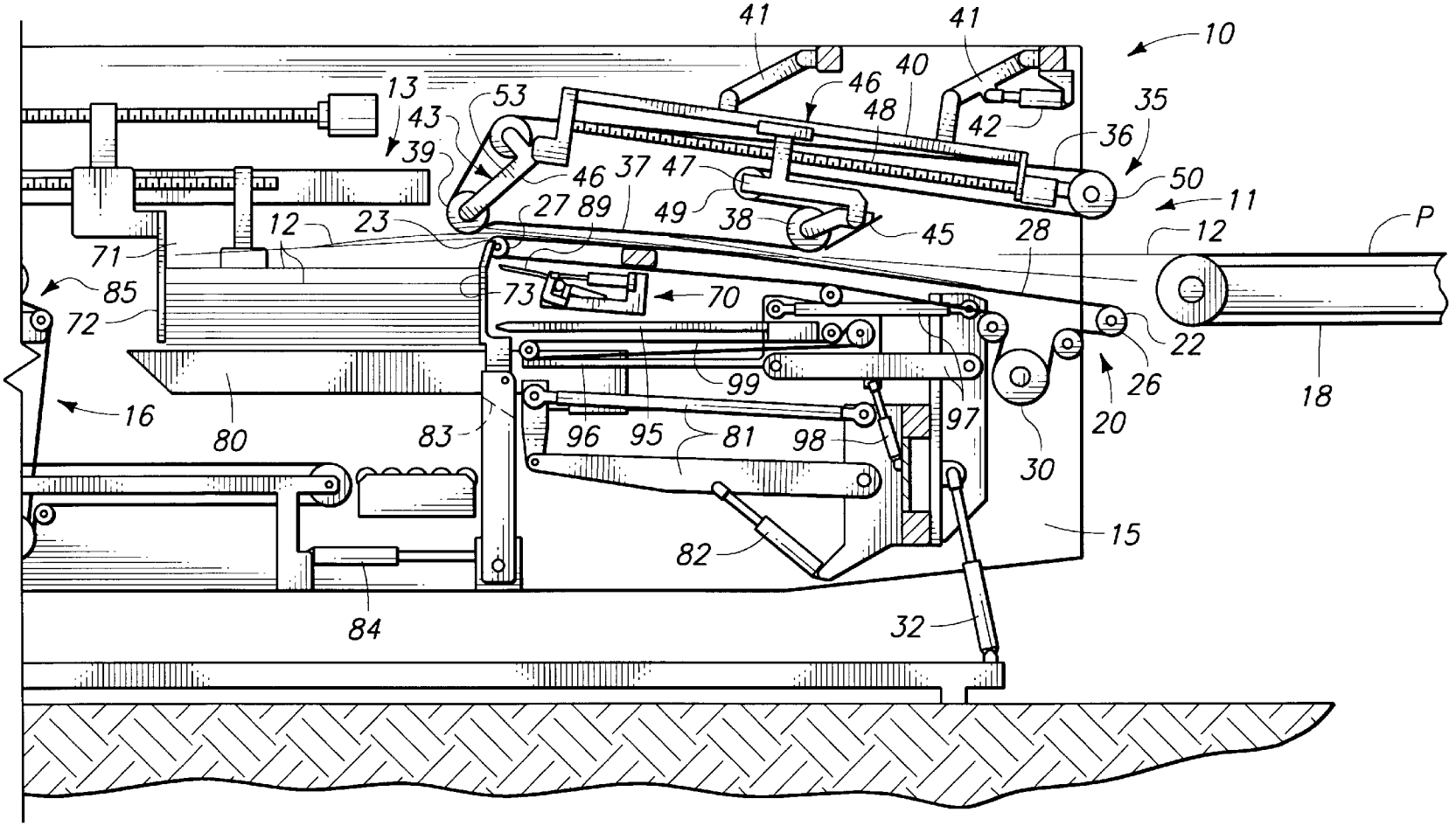

FIG. 4 indicates the mounting structure for the hold-down conveyor 35, including a hold-down frame 40. The hold-down frame 40 is suspended by a parallelogram linkage 41 from the primary frame 15 to enable selective adjustment of the height for the hold-down conveyor working flight 37 over the working flight 21 of the shingling conveyor 20. A cylinder 42 is mounted between the primary frame 15 and the linkage 41 to selectively adjust this height according to the thickness dimension of the shingled boxes 12 received on the shingling conveyor 20.

The infeed end of hold-down conveyor 35 is provided with a nip plate 45 that is positioned to deflect boxes 12 received from the upstream apparatus 18 onto the shingling conveyor adjacent its infeed end. Leading edges of successive boxes 12 fed into the shingling conveyor enter initially at the plane P and engage the nip plate 45 which is positioned at approximately one box length from the discharge of the upstream apparatus 18. The inclined nip plate 45 deflects the leading edge of the box downwardly onto the previously received box and guides the received box toward reception under the working flight 37 of the hold-down conveyor 35 at the infeed rolls 38.

FIG. 4 also illustrates a preferred form of adjustor 46 mounting the nip plate 45 for selective positioning toward and away from the infeed end 22 of the shingling conveyor. Adjustor 46 may be comprised of a sub-frame 47 that is adjustably mounted to the hold-down frame 40 for sliding movement initiated by a driving device such as a linear actuator 48. Resulting extreme positions of the nip plate 45 are shown in FIG. 4 by dashed line representations. Such adjustments are made according to the length (along the feed direction) of the boxes 12 being fed from the upstream apparatus 18.

Hold-down conveyor infeed rolls 38 are positioned just slightly downstream of the nip plate 45 on the sub-frame 47 for movement with the sub-frame 47 and nip plate 45. Idler pulleys 49 are also mounted to the sub-frame 47 for movement with the sub-frame 47. Upstream training rolls 50 are mounted to the hold-down frame 40, as are the deflector rolls 39 (though the deflector rolls are preferably individually movable elevationally and may be adjusted up or downstream if desired). Thus the sub-frame 47 along with nip plate 45, infeed rolls 38 and idler pulleys 49 may be selectively positioned by the adjustor 46 along the working flights 37 between the deflector rolls 39 and upstream rolls 50 without affecting the length of the hold-down belts 36.

The infeed rolls 38 position the hold-down belts 36 to immediately receive and press against the boxes 12 deflected downwardly by the nip plate 45. The belts 36 thus serve to hold the partially formed box flaps down while any applied glue continues to set.

Attention is now drawn to the deflector end 43 of the hold-down conveyor 35 and particularly to FIG. 6. The deflector end 43 is partially comprised of the deflector end rolls 39, which are positioned beyond the counter-ejector discharge end 23 of the shingling conveyor 20 in order to maintain control over the boxes being discharged from the shingling conveyor 20 to the counter-ejector 13. The deflector end 43 operates in conjunction with and assists efficient operation of a temporary trailing edge support device 70 (to be described in greater detail below).

In preferred forms, the deflector end 43 includes an elevation adjustor 46 connected to the deflector end rolls 39 to selectively determine a discharge trajectory of boxes leaving the counter-ejector discharge end 23 of the shingling conveyor 20. The elevation adjustor 46 is advantageously comprised of a pivoted arm 53 mounted to the hold-down conveyor frame 40. The pivoted arm 53 may be biased by ordinary means or, more preferably, is simply swings downwardly by gravity about its pivot axis. The combined weight of the arm 53 and the deflector end rolls 39 thus bear down and exert elevational motion and trajectory control on any boxes leaving the shingling conveyor 20.

Boxes leaving the shingling conveyor 20 move past the discharge end rolls 27 and are deflected downwardly by the deflector end rolls 39 so the leading edges of the boxes will either engage the top of the stack 14 presently being formed, or will engage a downstream wall 72 of a counter-ejector magazine 71. In either instance the box 12 is diverted downwardly from the upwardly inclined angle of the shingling conveyor 20. This advantageously decreases the chance for the box to flip upwardly or to "float" unpredictably downwardly in the magazine 71 to the top of the stack 14. Instead, the downstream deflector rolls 39 (and associated belts 36) maintain control and predictably direct the box downwardly toward the stack 14, making the release time for the trailing edge of the box predictable.

Boxes 12 are delivered from the counter-ejector discharge end 23 of the box feeder 11 to the counter-ejector 13 which is also mounted to the primary frame 15. The counter-ejector 13 includes the magazine 71 which is situated downwardly of and adjacent to the counter-ejector discharge end 23 of the box feeder 11 to receive a steady and continuous flow of boxes for stacking.

Successive boxes 12 are deposited in a stream, leading edges first into the top opening of magazine 71. The boxes 12 are guided downwardly into the magazine 71 by the deflector end 43 of the hold-down conveyor 35 and settle in a counted stack on a support surface, preferably lift forks 80 or onto a set of stripper arms 95, both of which are movably mounted on the primary frame 15 adjacent to the open bottom of the magazine 71.

On entering the magazine 71 from the box feeder 11, the leading edges of the boxes move against the downstream wall 72 which acts as a stop surface to form the leading edge of the presently forming stack 14. The trailing edges of the boxes 12 subsequently drop within the magazine 71 onto the lift forks 80, progressively forming a stack 14 as the lift forks are lowered.

The boxes 12 initially accumulate in a stack 14 on the lift forks 80 after being counted by an appropriate conventional upstream counting device 65 (FIGS. 6–10) on the box feeder 11. The lift forks 80 move elevationally, lowering as the stack is formed from a raised position (FIG. 5) to a lowered position (FIG. 11). This motion is initiated by the counting device and proceeds according to the box feed rate from the box feeder 11.

A parallelogram lift device 81 (FIGS. 5 and 11) holds the lift forks 80 horizontal throughout movement between the raised and lowered positions. A lift cylinder 82 is provided between the primary frame 15 and the parallelogram lift members to selectively raise and lower the lift forks in timed relation with delivery of boxes from the box feeder 11.

Each successive stack is removed from the lift forks 80 (as they reach their lowered positions) by action of a stack pusher 83 (FIG. 11). A cylinder 84 is connected between the primary frame 15 and the pusher 83 to effect lateral movement of the pusher to shift the formed stack off the lift forks and onto the press conveyor 16 that is also mounted to the primary frame 15.

The pusher 83 is normally situated adjacent to and forms part of the upstream magazine wall 73. The lift forks 80 will lower to a position where the pusher 83 is laterally adjacent the formed stack, at which time the cylinder 84 is activated to push the stack laterally from the lift forks to the press conveyor 16. The cylinder then retracts the pusher 83 to the normal position, during which time the lift forks are elevated to their raised position to receive the next successive stack.

The pusher 83 shifts the stack to the compression conveyor 85 where the stack is moved from the counter-ejector area for further handling. Press conveyor 16 includes a powered bottom flight 86 that receives and supports the successive stacks. A top compression flight 87 serves to continue firm engagement against the top surfaces of the stacks, compressing the boxes against the bottom flight 86 in the stacks to assure the glue will have more than adequate drying time.

It is desirable for the present machine to operate continuously to avoid stoppage or slow-down of upstream operations. To accomplish this, intermediate support must be provided for boxes being fed into the magazine 71 while the pusher 83 is operating and while the lift forks 80 are being returned to their raised positions. Such intermediate support is provided by the temporary trailing edge support device 70 and stripper arms 95 that will now be described.

As the last counted box is received on the lift forks 80, stripper arms 95 are inserted into the magazine to receive the first boxes that will form the next stack (FIG. 9). As this is done the previously formed stack is moved down and away from the lift forks 80. The presently forming stack is then held on the arms 95 until the lift forks return.

Figure 5:
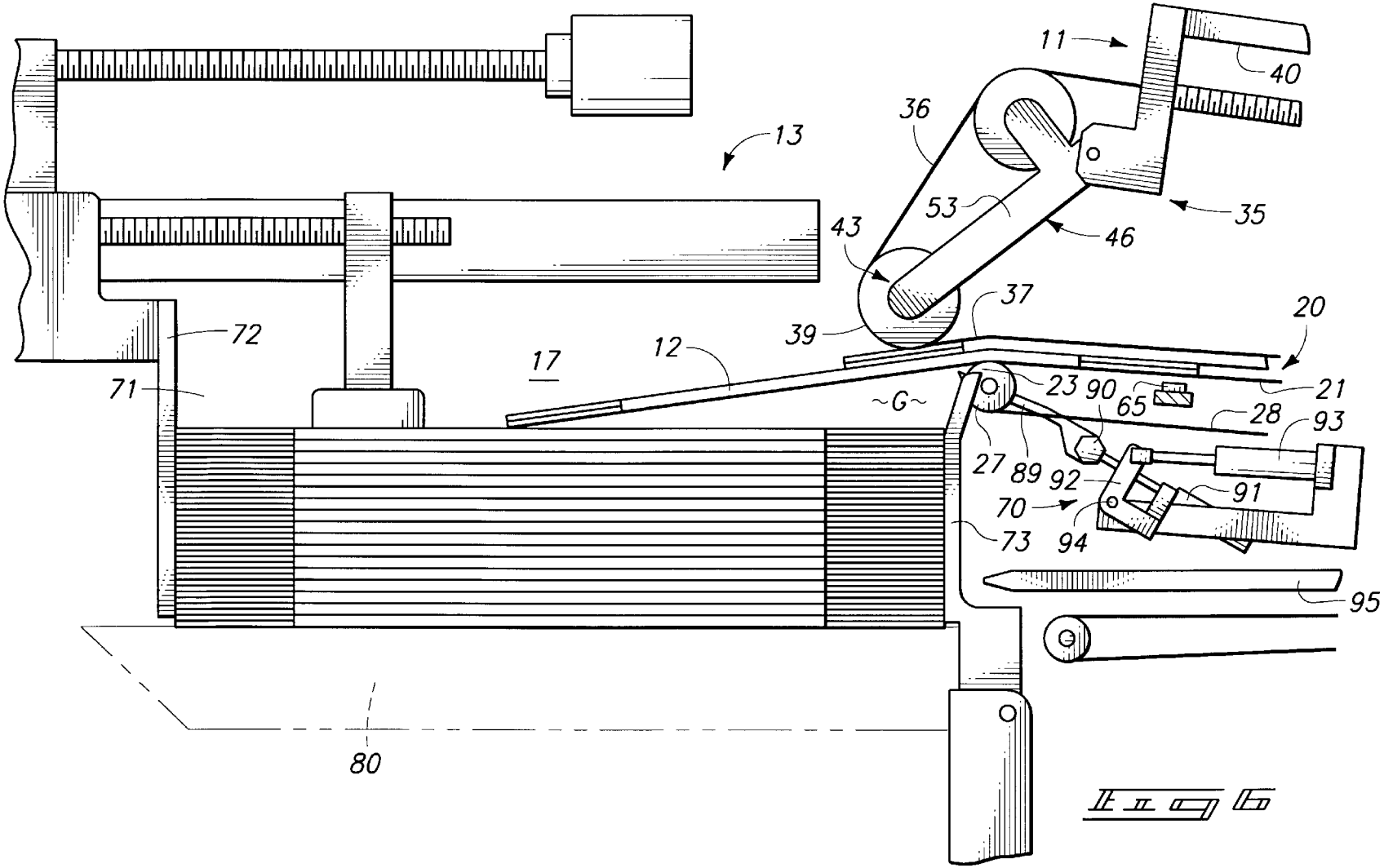
FIG. 5 is a side elevation view of the counter-ejector and box feed machine with a side plate removed for clarity.
Figure 11:
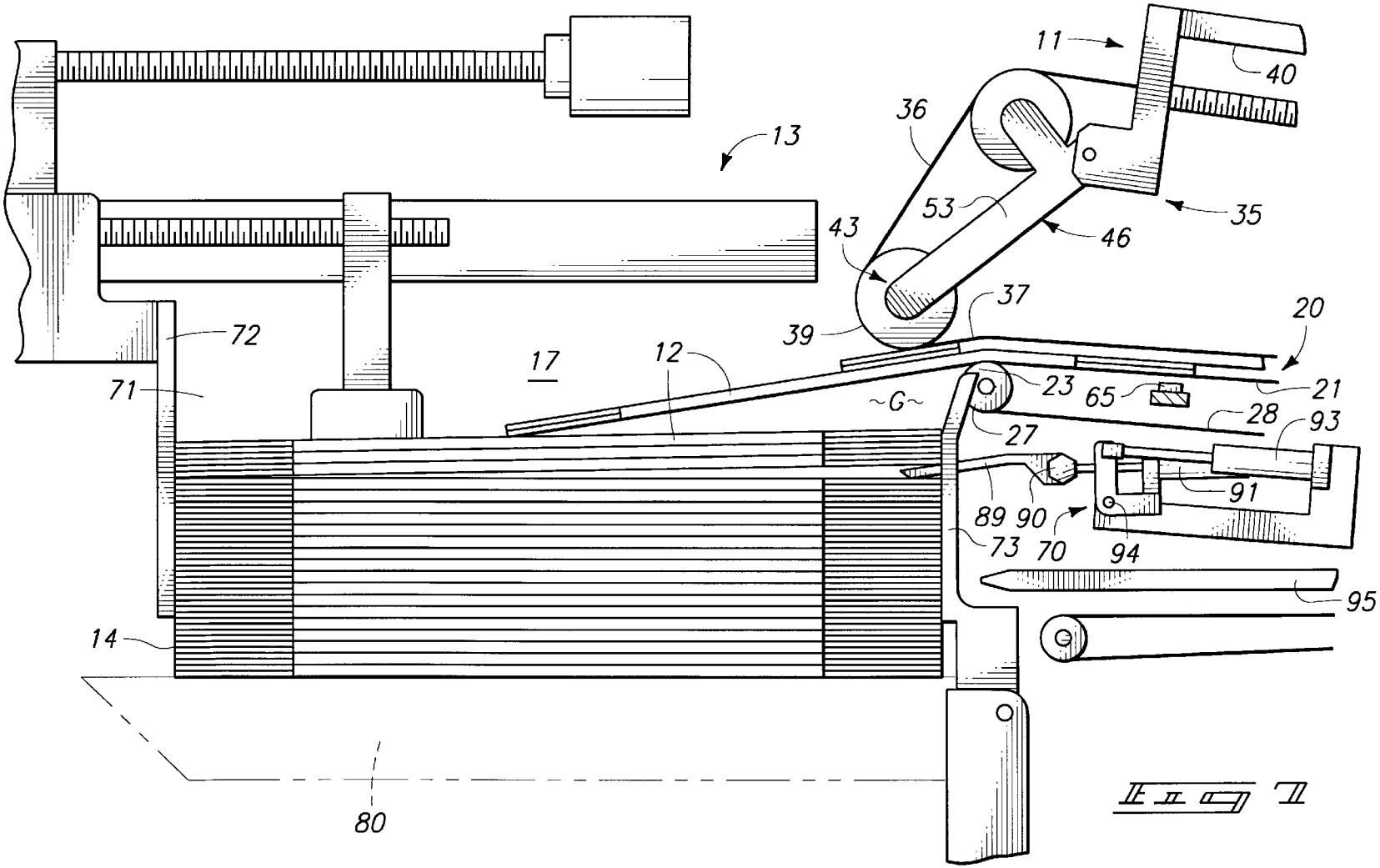
Figure 11:
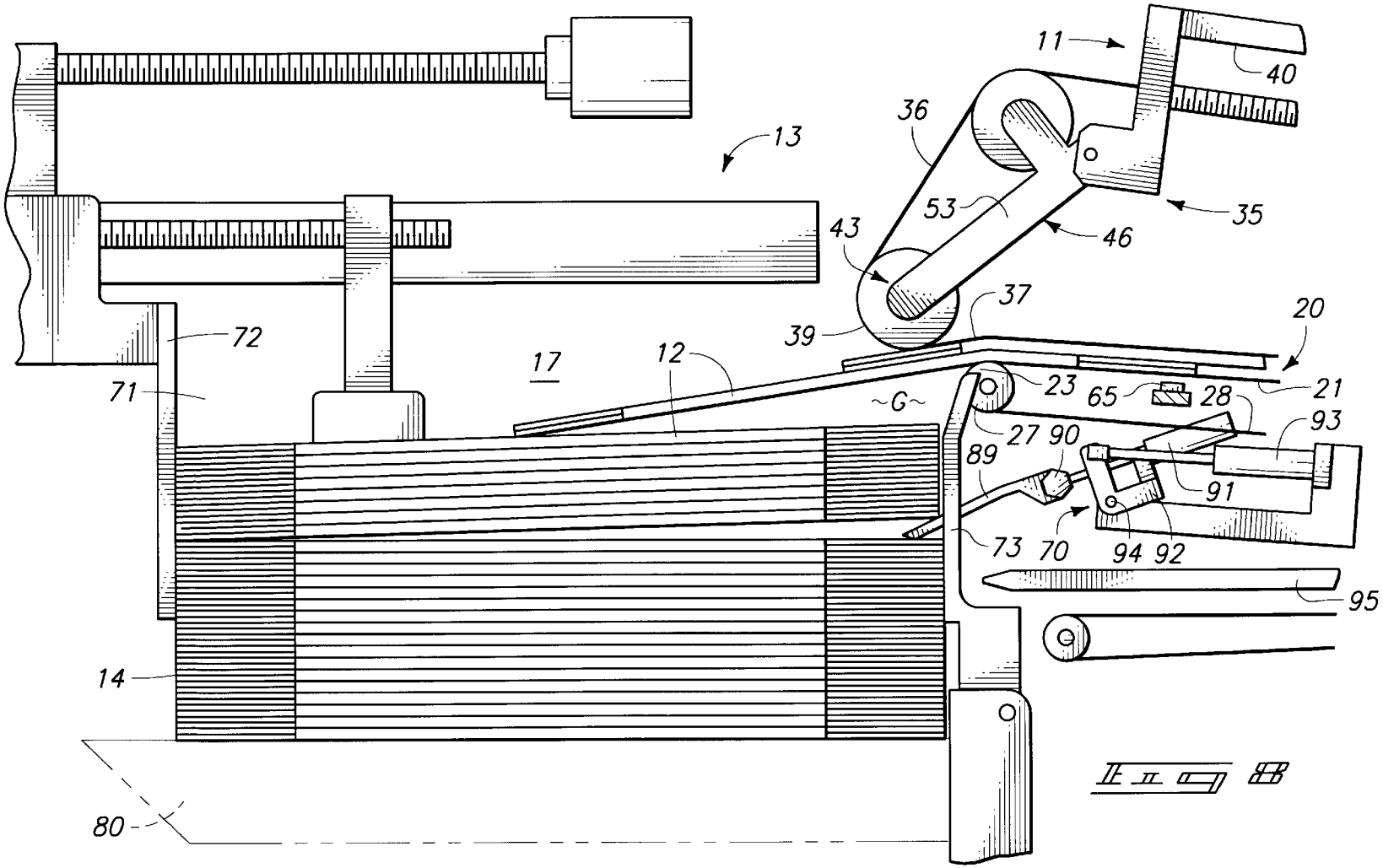
Figure 11:
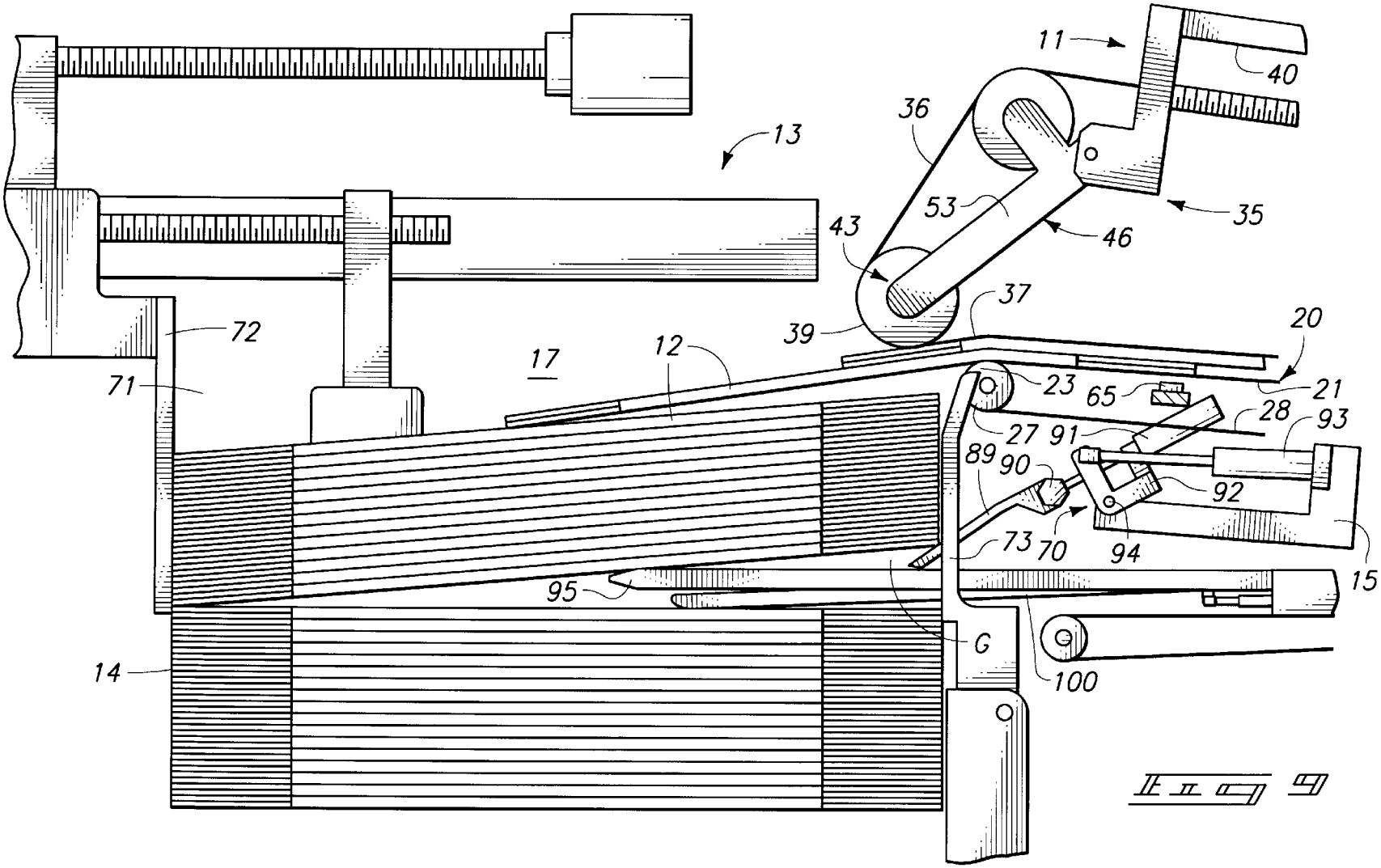
Figure 11:
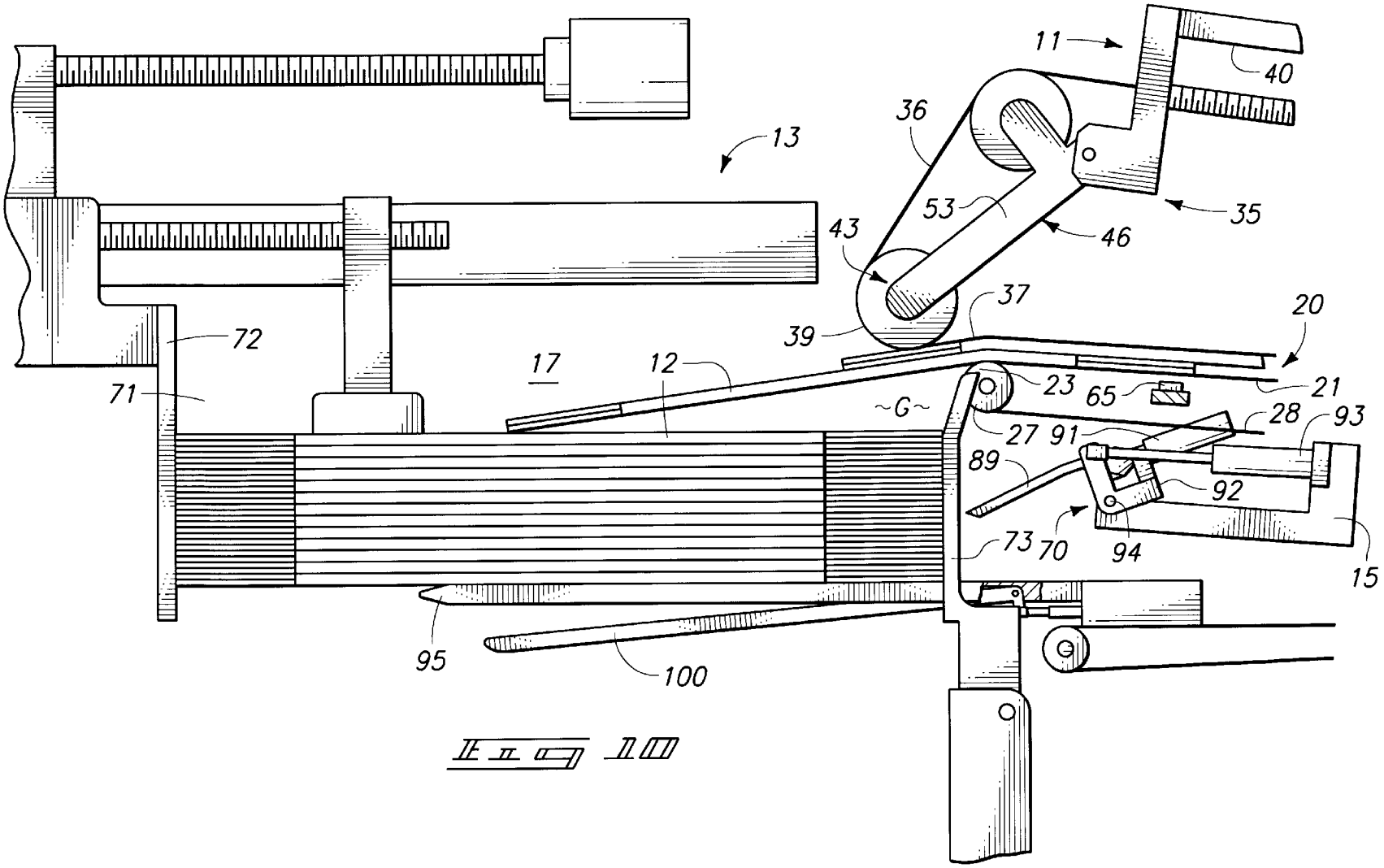
Figure 11:
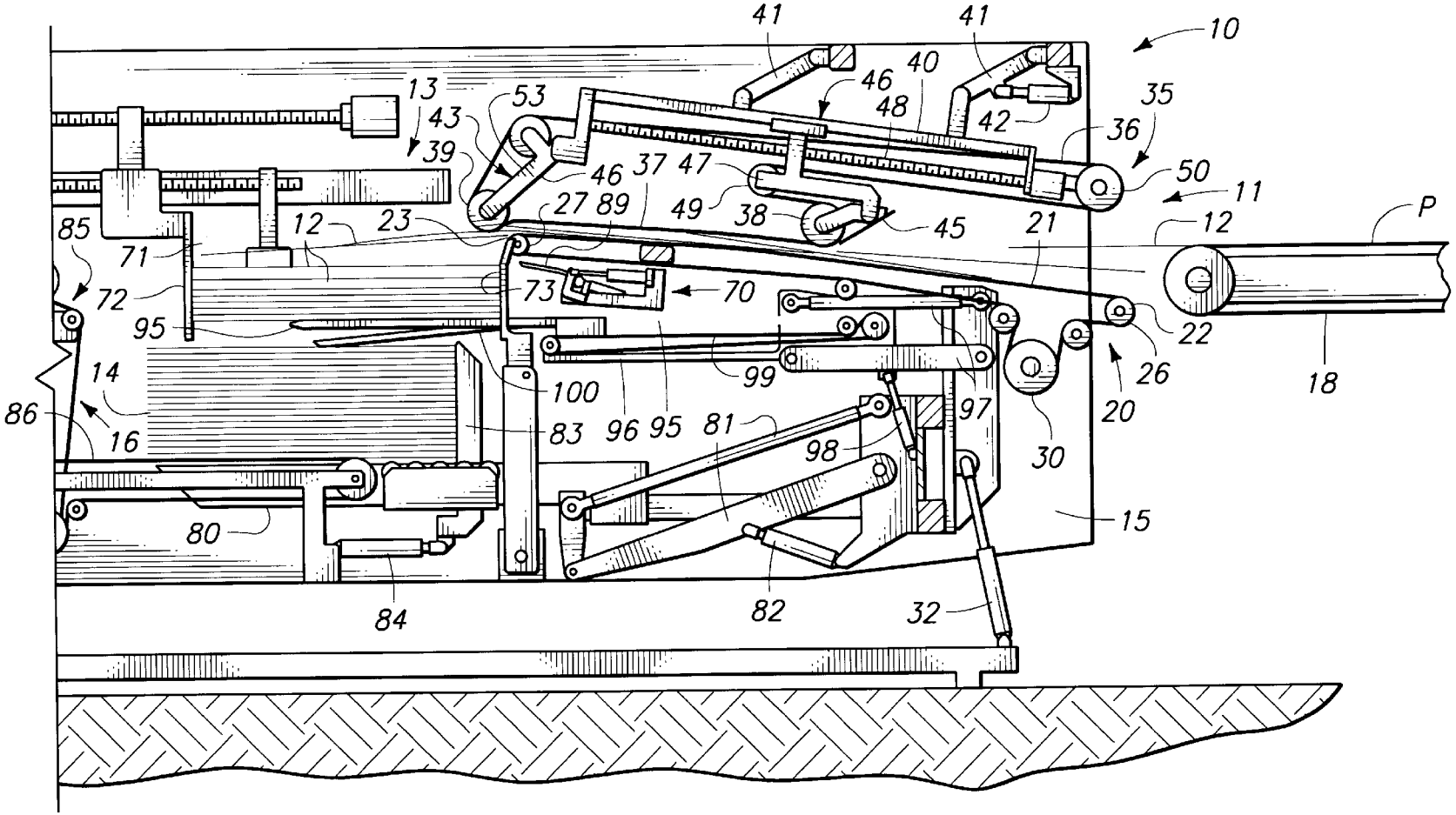

The stripper arms 95 are mounted on linear bearings for reciprocating forward and rearward movement on a carriage 96 (FIGS. 5, 11). A belt drive mechanism 99 is also provided on the carriage 96 to extend and retract the stripper arms 95.

The carriage 96 is mounted by a parallelogram linkage 97 to the primary frame 15 for elevational movement that is selectively effected by a cylinder 98. The stripper arms 95 will therefore move both horizontally and vertically.

A typical operational cycle for the stripper arms involves: (1) an initial horizontal movement in which the stripper arms are moved forwardly into the magazine 71 (FIG. 9); (2) a downward movement within the magazine to a lowered position as boxes are delivered (FIG. 10); (3) a retracting horizontal movement at the lowered position to strip the stack being formed against the upstream wall 73 of the magazine 71 and onto the lift forks 80 (FIG. 13); then (4) raising back to the starting position upstream of the magazine 71 in preparation for another cycle (FIG. 5).

Figure 12:
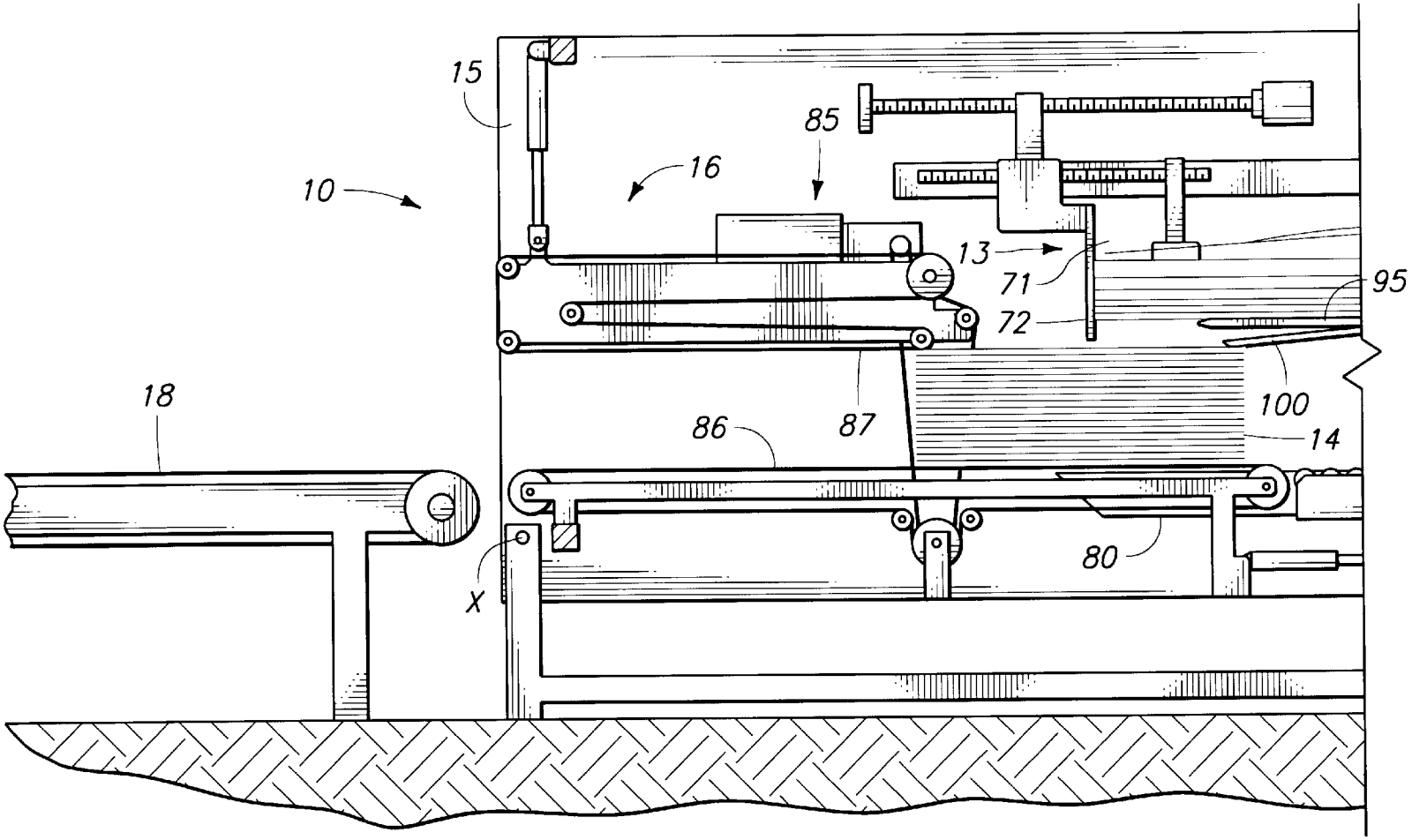
Figure 11:
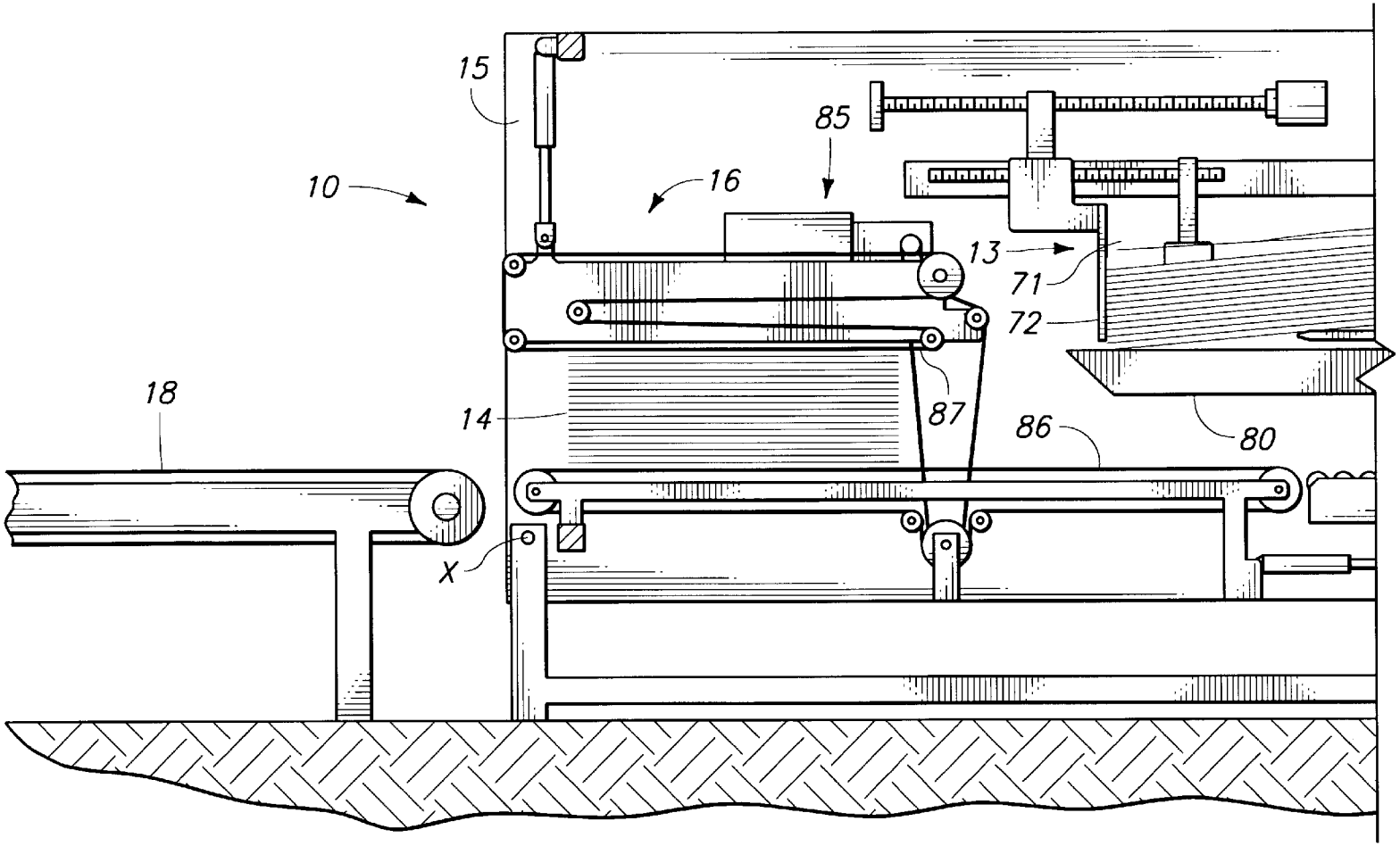
Figure 11:
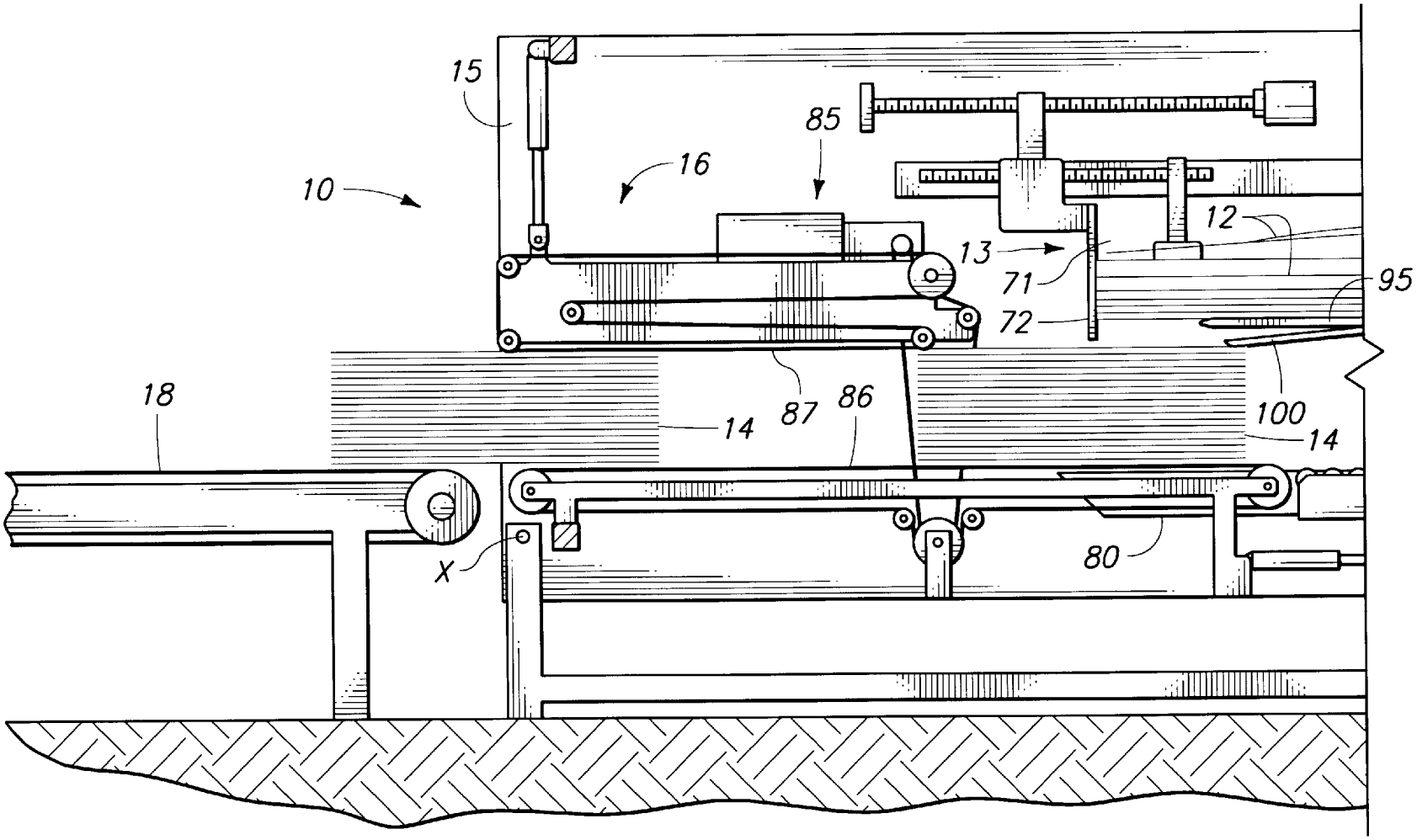

Hold-down arms 100 (FIG. 10) are provided on the bottom sides of the stripper arms 95 to drop down and press against the top surface of the stack presently resting on the lift forks 80 (see FIG. 10–12). The arms 100 are pivotably mounted to the stripper arms and may be selectively lifted or lowered by action of a cylinder mounted between the arms 100 and the primary frame 15. It is preferred that the hold-down arms 100 remain in contact with the top surface of the formed stack until it is removed from the lift forks 80, at which time the top surface is engaged and pressed down by the compression conveyor 85.

It is pointed out that the top surfaces of all boxes handled by the present machine are constantly pressed downwardly with clamping forces to allow for proper setting of glue applied to the box flaps. The box flaps are held closed from the time they are received on the shingling conveyor until such time that the formed bundles leave the compression conveyor 85.

The presently preferred temporary trailing edge support device 70 operates just prior to insertion of the stripper arms 95 to maintain a gap G between the top of the formed stack 14 and the bottom of the next successive stack being delivered into the magazine 71. The stripper arms 95 are inserted into the formed gap G and are then indexed downwardly to provide temporary support for the forming stack while the previously deposited complete stack 14 is removed and the lift forks 80 return to a position to receive the presently forming stack.

Referring now in greater detail to the present trailing edge support device 70, reference will be made specifically to FIGS. 3 and 6–9. There the device 70 is shown mounted to the primary frame 15 immediately below the counter-ejector discharge end 23 of box feeder 11, and along the upstream side of magazine 71.

Figure 3:
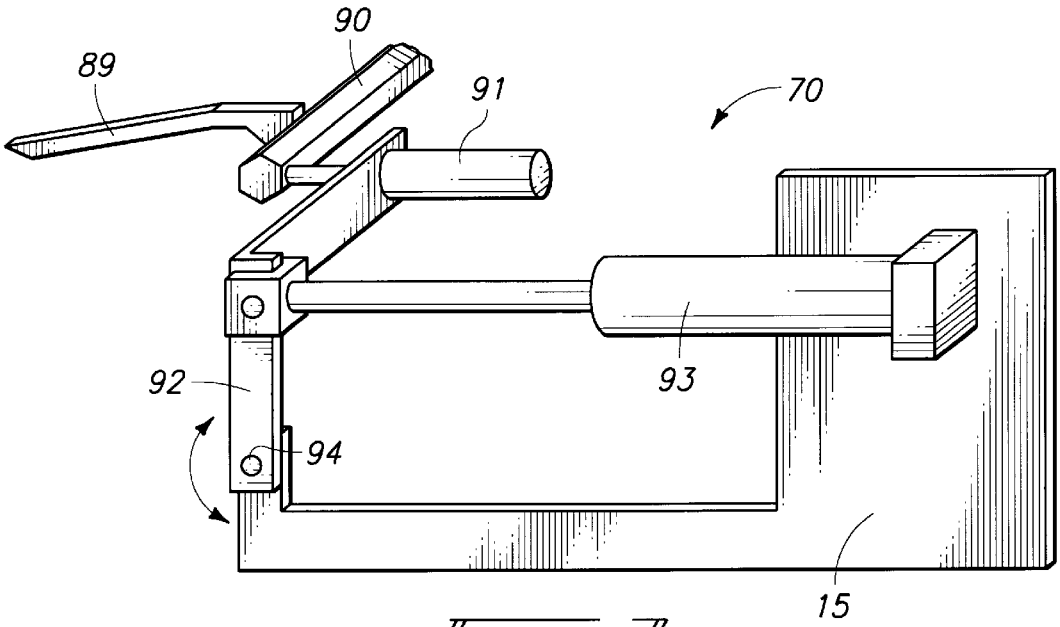
FIG. 3 is a perspective fragmented view of a trailing edge support device.

Trailing edge support device 70 includes a plurality of trailing edge support fingers 89 that are, in a preferred form, mounted to a carriage bar 90 that extends transversely across the magazine 71. The fingers 89 and carriage bar 90 are selectively movable into and out from the magazine 71 by operation of a cylinder 91 which is best seen in FIG. 3.

A bell crank member 92 mounts the cylinder 91, carriage bar 90, and fingers 89 to the primary frame 15 for pivotal motion about the axis of a pin 94. A pivot cylinder 93 is mounted between the bell crank member 92 and the primary frame 15 and is operative to pivot the above elements up and downwardly about the pin axis.

It is noteworthy at this point to discuss the relationship of the box feeder, particularly the deflector rolls 39, and the temporary trailing edge support 70. The shingled boxes, being transported along the box feeder, leave the discharge end 23 and are deflected downwardly by the deflector rolls 39. Thus the leading edge of the top box in a stack will be deflected downwardly onto the stack, and its trailing edge will spring downwardly by pressure applied from the leading edge of the next successive overlapping box (which is also deflected downwardly by the deflector rolls 39).

In fact it is the leading edge of the next successive sheet that springs the top sheet down, due to pressure applied by the deflector rolls 39, leaving the wedge shaped gap G between the top of the completed stack and the bottom box of the next successive stack. The gap produced by the deflector rolls 39 remains until the trailing edge of the next box leaves engagement with the discharge end 23 of the shingling conveyor 20.

The counting device 65 senses when a selected number of boxes have been discharged into the magazine by counting the trailing edges of boxes as they pass by on the shingling conveyor. Once the prescribed number of boxes have moved past, a signal initiates operation of the trailing edge support finger cylinders 91 and 93.

Firstly, the cylinder 91 is activated to extend (FIG. 6). As this happens, the trailing edge support fingers 89 are moved angularly upward into the gap G created by the deflector rolls 39. Next the cylinder 93 is activated to extend and pivot the fingers downwardly (FIGS. 7, 8) to press against the top of the formed stack.

While the above steps take place, boxes continue to be delivered into the magazine 71. The trailing edges of these boxes are temporarily supported on the trailing edge support fingers 89. The gap G is maintained by the support fingers 89 while the stripper arms 95 are inserted beneath the newly forming stack. The accumulating successive stack is thus supported without interrupting the infeed flow while the previously formed stack 14 moves on through the compression conveyor 85.

As the stripper arms 95 are inserted, the cylinder 91 is activated to retract (FIGS. 9, 10), pulling the fingers angularly upwardly and outwardly from the magazine 71. Once the fingers 89 are fully retracted from the magazine 71, the cylinder 93 is retracted to pivot the fingers back upwardly to their starting positions (FIG. 5), ready for another cycle.

The trailing edge support fingers 89 move through slots formed in the upstream wall 73 of the magazine 71. The wall side 73 is defined plates which also may pivot, acting as a tamper to vertically register the box leading and trailing edges in the stack. Conventional end tampers may also be provided as presently known for maintaining the end edges of the boxes 12 in similar vertical registration.

Given the above description of the machine 10, the present process and overall operation may now be understood. The present process involves a series of steps that will be described in general order but not specifically in a ordered sequence. Further, the process will be described assuming the present machine is starting empty, without any boxes in place either in the magazine 71 or along the box feeder 11

As a first step, a succession of boxes are fed to the box feeder 11 in a continuous stream. The boxes 12 are typically fed from forming and printing apparatus 18 upstream of the box feeder 11. The boxes 12 are fed from a single file, end-to-end relation from the upstream machine 18 and are formed into a shingled stream by the box feeder 11, with the leading edge of one box overlapping the trailing edge of the next downstream box.

The boxes delivered end-to-end from the upstream machine are discharged at the plane P, then initially strike the nip plate 45 where they are deflected downwardly onto the working flight of the shingling conveyor. The distance between the discharge for the upstream machine and the nip plate is determined by adjusting the nip plate back and forwardly to be approximately equal to the length of the boxes as measured in the direction of feed. The feed rate of the shingling conveyor 20 is determined in relation to the infeed from the upstream machine to be slower in order for a shingling effect to occur. If the feed rate from the upstream apparatus 18 is at 1,000 feet per minute, and a feed rate for the shingling conveyor is 500 feet per minute, the resulting overlap will be approximately 50%. One sheet will therefore overlap the preceding sheet by 50% of the sheet length. The shingled boxes will travel along the shingling conveyor with the tops held firmly down by the hold-down conveyor. As the boxes move toward the discharge end 23, the successive trailing edges are detected by the counting device 65. The counting device starts counting sheets and activates downstream apparatus in accordance with successive numbers counted. The boxes leaving the discharge end of the shingling conveyor are deflected downwardly by the weight of the deflector rollers 39. The boxes are fed in the shingled configuration into the magazine 71 in such a manner that the top surface of one sheet is continuously engaged and held downward by the bottom surface of the next successive sheet. Therefore, no control is lost nor are the top flaps of the boxes left free at any time to open during the stack formation process.

Leading edges of the successive boxes are fed into the magazine 71 where they come into contact with the downstream wall 72. This wall aligns the leading edges of the sheets and allows the uniform stack to be accumulated.

The boxes initially accumulate on the lift forks 80 until such time that the counting device 65 detects the presence of the last counted box. This box will become the top of the stack.

After a time delay based upon the feed rate for the sheets, the temporary trailing edge support device 70 is activated. This occurs within the time between the discharge of the last box and discharge of the next successive box which will form the bottom of the next successive stack. During this time the cylinder 91 is activated to move the fingers 89 into the gap G presently formed by operation of the deflector rolls 39 acting against the presently engaged box. Once the fingers are situated within the magazine, the trailing edge of the bottom box will move down and rest against the fingers 89. Thus, the gap G is maintained even as the stack lowers and additional sheets are delivered into the magazine. The support is found between the fingers 89 and the downstream wall 72 of the magazine. The leading edge of the newly forming stack is also supported at the top of the previously formed stack, until such time that the stripper arms 95 are inserted to accept the weight of the forming stack.

It is pointed out that during the time in which the fingers 89 are inserted to maintain the gap G, the same fingers are swung downwardly to engage the top box on the formed stack and to press downwardly, holding the box flaps closed. This is a part of the continuous engagement feature in which the received boxes are substantially continuously maintained in a compressed condition in order to assure that any glue applied to the flaps will dry before the boxes are discharged.

While the fingers 89 hold the top box closed at the top of the formed stack, the same fingers are used to maintain the gap G for insertion of the stripper arms 95. The arms 95 are inserted by operation of the belt drive 99. As soon as the stripper arms 95 are fully extended into the magazine, the completed stack is lowered and the pusher 83 is operated to move the completed stack laterally from the magazine. At this time the hold-down arms 100 are lowered to contact the top surface of the stack and to hold the folded flaps in the closed, compressed condition while the stack is moved toward engagement with the compression conveyor 16. The bottom flight 86 continues to move the bundle and at a point shown in FIG. 14, the top compression flight 87 engages and holds the top surface of the stack downwardly as the conveyor continues to operate, shifting the completed bundle or stack from the magazine 71.

The stripper arms continue to support the incoming boxes and will lower by increments until the lift arms are moved back and upwardly to receive the forming stack. At this time, the stripper arms retract, stripping the received boxes against the upstream wall 73 of the magazine and allowing them to drop onto the raised lift forks. The lift forks then index downwardly until such time that the last box is received at the top of the stack and the above process is repeated. It is pointed out that conventional controls may be utilized with the present machine so that operation is automatic. It is also pointed out that adjustment of the machine to receive boxes of different length dimensions is easily accomplished by simple adjustment of the machine which functions may also be accomplished automatically. For example, if different length boxes are to be delivered to the machine, the cylinder 32 may be activated to change the angular relationship between the shingling conveyor and the infeed plane P. This adjustment, since the box feeder 11, counter-ejector 13, and press conveyor 16 are all mounted to the primary frame 15, occurs without requiring further adjustment of these separate components to accommodate the adjusted angular position of the shingling conveyor. Further adjustments may include a repositioning of the nip plate 45 by simple operation of the linear actuator 48 to accommodate the new sheet length. Further adjustments may be made to increase or decrease the size of the magazine using similar adjustments.

It is also pointed out that the boxes fed from the plane P by the upstream apparatus 18 are engaged and held securely from both top and bottom surfaces throughout the shingling and counter-ejector operations. Thus, the box flaps will not have an opportunity to open. Instead, continuous downward pressure is applied throughout the time required for a glue to dry and hold the flaps together.

It is also noted that the entire operation including shingling of the boxes, and accumulation of the boxes within the counter-ejector, and discharge of the stacks is a continuous operation that does not require slowing down or interruption of the upstream feeding apparatus.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A box feed and counter-ejector for receiving successive boxes delivered at a prescribed rate in end-to-end relation along a delivery plane, and for accumulating the boxes for discharge in a stacked bundle, comprising:

a frame;

a shingling conveyor on the frame including an elongated working flight leading from an infeed end to a discharge end;

wherein the infeed end of the shingling conveyor is positioned below the infeed plane;

a driver connected to the shingling conveyor and selectively operable to move the working flight in a direction away from the infeed end;

wherein the shingling conveyor is movable about a pivot axis situated downstream of the discharge end whereby the infeed end is angularly adjustable about the pivot axis relative to the infeed plane through an angular range and the discharge end is substantially elevationally stationary relative to the infeed end; and a counter-ejector at the discharge end mounted to the frame for pivotable movement with the shingling conveyor and configured to receive and stack boxes delivered from the shingling conveyor.

2. The box feed and counter-ejector of claim 1 further comprising a hold-down conveyor positioned engage and press against shingled boxes moving along the working flight of the shingling conveyor.

3. The box feed and counter-ejector of claim 1 further comprising:

a hold-down conveyor positioned engage and press against shingled boxes moving along the working flight of the shingling conveyor; and a nip plate on the hold-down conveyor positioned to deflect boxes onto the shingling conveyor adjacent the infeed end.

4. The box feed and counter-ejector of claim 1 further comprising:

a hold-down conveyor positioned engage and press against shingled boxes moving along the working flight of the shingling conveyor;

a nip plate on the hold-down conveyor positioned to deflect boxes onto the shingling conveyor adjacent the infeed end; and an adjustor mounting the nip plate for selective positioning toward and away from the infeed end of the shingling conveyor.

5. The box feed and counter-ejector of claim 1 further comprising:

a hold-down conveyor positioned above the working flight of the shingling conveyor to engage and press against shingled boxes on the working flight of the shingling conveyor;

wherein the hold-down conveyor includes a deflector end projecting beyond the discharge end; and an elevation adjustor connected to the deflector end to selectively determine a discharge trajectory of boxes leaving the discharge end of the shingling conveyor.

6. The box feed and counter-ejector of claim 1 further comprising a nip plate positioned above the working flight of the shingling conveyor adjacent the infeed end thereof.

7. The box feed and counter-ejector of claim 1 further comprising:

a nip plate positioned above the working flight of the shingling conveyor adjacent the infeed end thereof; and an adjustor mounting the nip plate for selective positioning toward and away from the infeed end of the shingling conveyor.

8. The box feed and counter-ejector of claim 1 wherein the shingling conveyor is angularly adjustable about the pivot axis to vary the incline of the working flight through an angle of between approximately 6 and 18 degrees.

9. The box feed and counter-ejector of claim 1 wherein the frame and the shingling conveyor are mounted for selective angular adjustment about said axis to enable selective angular adjustment of the shingling conveyor relative to the infeed plane.

10. A process for stacking boxes of material having leading and trailing edges, comprising the steps of:

providing an box feeder having an infeed end and a discharge end;

operating the box feeder to move the boxes in a shingled stream leading edge first toward the discharge end;

providing a magazine downstream of and below the box feeder discharge end;

deflecting the shingled stream of boxes downwardly from the discharge end of the box feeder such that the boxes drop elevationally into the magazine to progressively form a first stack;

movably supporting the progressively forming first stack;

forming a gap between boxes being deflected downwardly at the discharge end and the first stack;

detecting when a selected number of boxes are received on the first stack;

moving a trailing edge support finger into the gap when the selected number of boxes have been received on the first stack;

receiving and supporting the trailing edge of a next box received within the magazine above the first stack on the trailing edge support fingers, and supporting successive trailing edges of boxes received within the magazine initiating formation of a second stack on the trailing edge support fingers above the first stack to form an opening between said next box and the first stack;

moving an intermediate stripper plate into the gap to support the second stack of boxes being formed above said first stack;

withdrawing the trailing edge support fingers from the magazine;

removing the first stack of boxes from the support surface; and withdrawing the intermediate stripper plate to strip the forming second stack from the intermediate stripper plate and onto the support surface.

11. A counter-ejector and box feeder for receiving flexible boxes delivered in end-to-end relation along a delivery plane, comprising:

a frame;

a shingling conveyor on the frame configured to receive individual boxes at an infeed end and to deliver the boxes in a shingled stream from an infeed end to a discharge end;

a magazine on the frame adjacent the discharge end for reception of boxes delivered by the shingling conveyor;

a stripper arm mounted on the frame adjacent the magazine and movable between an extended position within the magazine for receiving successive boxes from the shingling conveyor, and a retracted inoperative position clear of the magazine;

a lift fork on the frame below the extended position of the stripper arm, and movable elevationally between an elevated stack receiving position and a lowered stack discharge station;

wherein the stripper arm is retractable to the inoperative position to strip a stack of boxes received thereon onto the lift fork;

a stack top hold-down arm on the stripper arm and elevationally movable below the extended position of the stripper arm to slidably rest against a top surface of a stack of boxes received on the lift fork, and to lift upwardly and move with the stripper arm to the inoperative position clear of the magazine; and a compression conveyor on the frame positioned adjacent the magazine to receive successive stacks from the lift fork and to move the successive stacks laterally from the lift fork; and wherein the frame is movable about a pivot axis situated adjacent the compression conveyor to vary the angular position of the shingling conveyor.

12. A process for delivering the shingled boxes to a counter-ejector, comprising the steps of:

feeding individual boxes having top and bottom surfaces along a plane in substantial end-to-end relation;

orienting an infeed end of a shingling conveyor below the infeed plane in a position to receive individual boxes delivered along the infeed plane;

depositing the boxes at the box feed station onto the shingling conveyor in an overlapping, shingled course with top surface of boxes being partially overlapped by bottom surface of succeeding boxes;

operating the shingling conveyor to move the shingled course up an incline to a discharge end;

pressing the top surfaces of boxes in the shingled course down against the bottom surface; and deflecting the shingled course downwardly at the discharge end by pressing the top surfaces of the boxes downwardly; and collecting the boxes onto a stack on a counter ejector; and providing the shingling convevor and counter ejector on a frame that is pivoted on an axis downstream of the discharge end such that the shingling conveyor and counter-ejector may pivot together about the axis to accommodate boxes of varying dimension.

13. The process set out by claim 12, comprising the step of:

angularly adjusting the shingling conveyor and counter-ejector about an axis situated adjacent the counter-ejector discharge end to accommodate boxes of varying dimension.

14. The process set out in claim 12 comprising the further step of producing a gap between boxes leaving the discharge end and the stack; and inserting a temporary support into the gap.

* * * * *